US005085565A

United States Patent [19]

Barito

[11] Patent Number: 5,085,565

[45] Date of Patent: Feb. 4, 1992

[54] AXIALLY COMPLIANT SCROLL WITH ROTATING PRESSURE CHAMBERS

[75] Inventor: Thomas R. Barito, East Syracuse, N.Y.

[73] Assignee: Carrier Corporation, Syracuse, N.Y.

[21] Appl. No.: 586,643

[22] Filed: Sep. 24, 1990

[51] Int. Cl.[5] ..... F04C 18/04

[52] U.S. Cl. ..... 418/55.4; 418/55.5; 418/57

[58] Field of Search ..... 418/55.4, 55.5, 57

[56] References Cited

U.S. PATENT DOCUMENTS 4,992,032 2/1991 Barito et al. ..... 418/55.5
4,993,928 2/1991 Fraser, Jr. ..... 418/55.5

FOREIGN PATENT DOCUMENTS 55-60684 5/1980 Japan ..... 418/57
63-106388 5/1988 Japan ..... 418/55.5

*Primary Examiner*—John J. Vrablik

[57] ABSTRACT

One or more eccentrically located pressure pockets are defined between the orbiting scroll and a seal plate. The seal plate and pockets rotate while the orbiting scroll orbits. The pressure in the pockets provide a restoring moment relative to the overturning moment provided by the gas forces in addition to providing an axial bias for axial compliance. Because the moment is balanced, a reduced axial biasing force is necessary and thereby wear and friction losses are reduced. In the preferred embodiment, the seal plate is integral with the slider block.

14 Claims, 5 Drawing Sheets

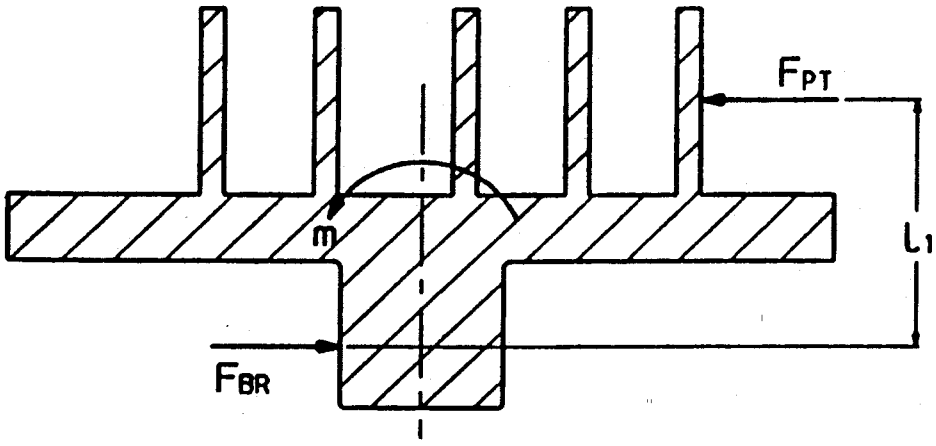

$F_{PT}$ = TANGENTIAL GAS FORCE
$F_{BR}$ = BEARING REACTION FORCE
$L_1$ = DISTANCE FROM $F_{PT}$ TO $F_{BR}$

OVERTURNING MOMENT = $F_{PT}$ X $L_1$

FIG. 5

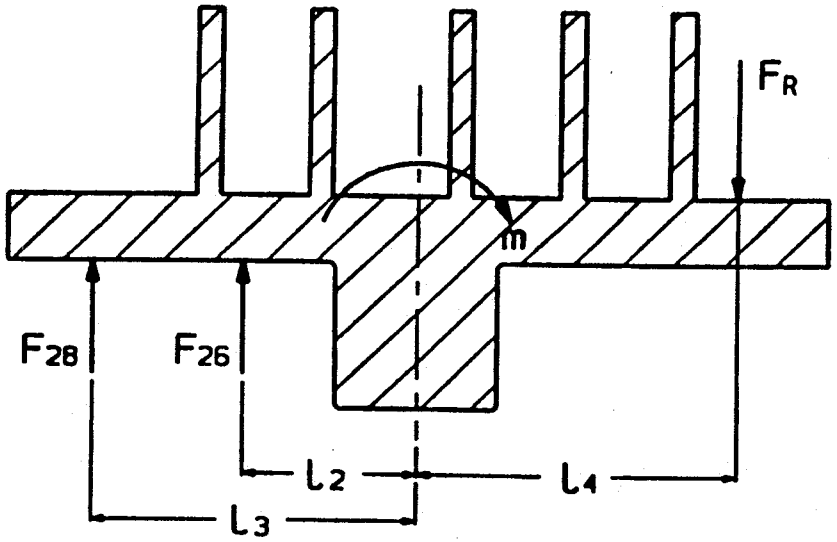

$F_R$ = THRUST FACE REACTION FORCE
$F_{26}$ = PRESSURE FORCE GENERATED BY BACK CHAMBER AREA -26-
$F_{28}$ = PRESSURE FORCE GENERATED BY BACK CHAMBER AREA -28-
$L_2$ = DISTANCE TO CENTROID OF AREA -26-
$L_3$ = DISTANCE TO CENTROID OF AREA -28-
$L_4$ = DISTANCE TO $F_R$

RESTORING MOMENT = $F_{26}(L_2)+F_{28}(L_3)+F_R(L_4)$

FIG. 6

AXIALLY COMPLIANT SCROLL WITH ROTATING PRESSURE CHAMBERS

BACKGROUND OF THE INVENTION

In a scroll compressor the trapped volumes are in the shape of lunettes and are defined between the wraps or elements of the fixed and orbiting scrolls and their end plates. The lunettes extend for approximately 360° with the ends of the lunettes defining points of tangency or contact between the wraps of the fixed and orbiting scrolls. These points of tangency or contact are transient in that they are continuously moving towards the center of the wraps as the trapped volumes continue to reduce in size until they are exposed to the outlet port. As the trapped volumes are reduced in volume the ever increasing pressure acts on the wrap and end plate of the orbiting scroll tending to axially and radially move the orbiting scroll with respect to the fixed scroll. Because the trapped volume may contain a liquid slug of refrigerant and/or oil it is desirable to permit inward radial movement of the orbiting scroll to permit leakage from the trapped volume(s) to relieve any excessive buildup of pressure.

Radial movement of the orbiting scroll away from the fixed scroll is controlled through radial compliance. One approach has been to use an eccentric bushing mechanism to provide the connection between the crankshaft and the orbiting scroll. Another approach has been to use a swing link connection between the orbiting scroll and crankshaft. A slider block radial compliance device is briefly mentioned in U.S. Pat. No. 3,924,977. In this patent, the centrifugal force of the orbiting scroll is used to activate the mechanism. The line of movement of the orbiting scroll is along the centrifugal force, i.e. along the line extending from the center of gravity of the counterweight through the center of the crankshaft to the center of the orbiting scroll. Each approach ultimately relies upon the centrifugal force produced through the rotation of the crankshaft to keep the wraps in sealing contact.

Axial movement of the orbiting scroll away from the fixed scroll produces a thrust force. The weight of the orbiting scroll, crankshaft and rotor may act with, oppose or have no significant impact upon the thrust force depending upon whether the compressor is vertical or horizontal and, if vertical, whether the motor is above or below the orbiting scroll. Also, the highest pressures correspond to the smallest volumes so that the greatest thrust loadings are produced in the central portion of the orbiting scroll but over a limited area. The thrust forces push the orbiting scroll against the crankcase with a large potential frictional loading and resultant wear. A number of approaches have been used to counter the thrust forces such as tip seals, thrust bearings and a fluid pressure back bias on the orbiting scroll. Wrap tip seals have inherent leak losses and require accurate machining of a groove in the tip of each scroll wrap. Discharge pressure and intermediate pressure from the trapped volumes as well as an external pressure source have been used to provide the back bias. Specifically, U.S. Pat. Nos. 3,600,114, 3,924,977 and 3,994,633 utilize a single fluid pressure chamber to provide a scroll biasing force. This approach provides a biasing force on the orbiting scroll at the expense of very large net thrust forces at some operating conditions. As noted, above, the high pressure is concentrated at the center of the orbiting scroll but over a relatively small area. If the area of back bias is similarly located, there is a potential for tipping since some thrust force will be located radially outward of the back bias. Also, with the large area available on the back of the orbiting scroll, it is possible to provide a back bias well in excess of the thrust forces.

U.S. Pat. No. 3,874,827 and 4,767,293 disclose pressure biasing of the non-orbiting scroll. Discharge pressure, an intermediate pressure or a pressure reflecting a combination of discharge and intermediate pressure are disclosed in U.S. Pat. No. 4,767,293.

One of the most challenging aspects of scroll compressor design is the development of adequate tip sealing for all operating conditions while minimizing thrust force friction losses. Previously, axial biasing of the orbiting scroll relied on a gas pressure force that is essentially centered with respect to the orbiting scroll geometry. This approach not only requires a restoring force to balance the axial separating forces but also a restoring moment to counteract the overturning moment on the orbiting scroll due to tangential gas forces. The end result is excessive tip thrust loading with resultant loss of efficiency.

SUMMARY OF THE INVENTION

The present invention utilizes pressure chambers that rotate with respect to the orbiting scroll back face. The pressure chambers are located in an eccentric manner such that the net pressure force on the orbiting scroll always creates a restoring moment to counteract the overturning moment due to gas compression forces. The net effect is that the gas pressure in the chambers is used primarily to counteract the axial separating forces within the scrolls. Therefore, the net thrust loads at the wrap tips are significantly smaller than those designs with centered pressure chambers.

It is an object of this invention to provide a wider and more stable operating envelope.

It is another object of this invention to improve axial compliance over the entire operating envelope.

It is a further object of this invention to minimize thrust losses on the back face of the orbiting scroll.

It is an additional object of this invention to provide an axial compliance mechanism that provides reduced thrust forces at the scroll tips.

It is further object of this invention to provide a combined radial and axial compliance member for a scroll compressor. These objects, and others as will become apparent hereinafter, are accomplished by the present invention.

Basically, one or more annular pressure chambers are formed between the orbiting scroll and a rotating member. The chambers are located eccentrically with respect to the center of the orbiting scroll as well as to each other. The combined rotary and orbiting motion causes a cyclic shifting of the chambers with respect to the axis of rotation of the rotating member but the net axial biasing forces are less than in conventional designs. In the preferred embodiment, the rotating member is integral with the slider block and is therefore capable of some radial movement as upon a liquid slug passing between the scroll wraps.

BRIEF DESCRIPTION OF THE DRAWINGS

For a fuller understanding of the present invention, reference should now be made to the following detailed description thereof taken in conjunction with the accompanying drawings wherein:

FIG. 5 is a free body diagram of the orbiting scroll showing how the overturning moment is generated; and FIG. 6 is a free body diagram of the orbiting scroll showing how the restoring moment is generated by the rotating pressure chambers.

DESCRIPTION OF THE PREFERRED EMBODIMENTS

Figure 1:
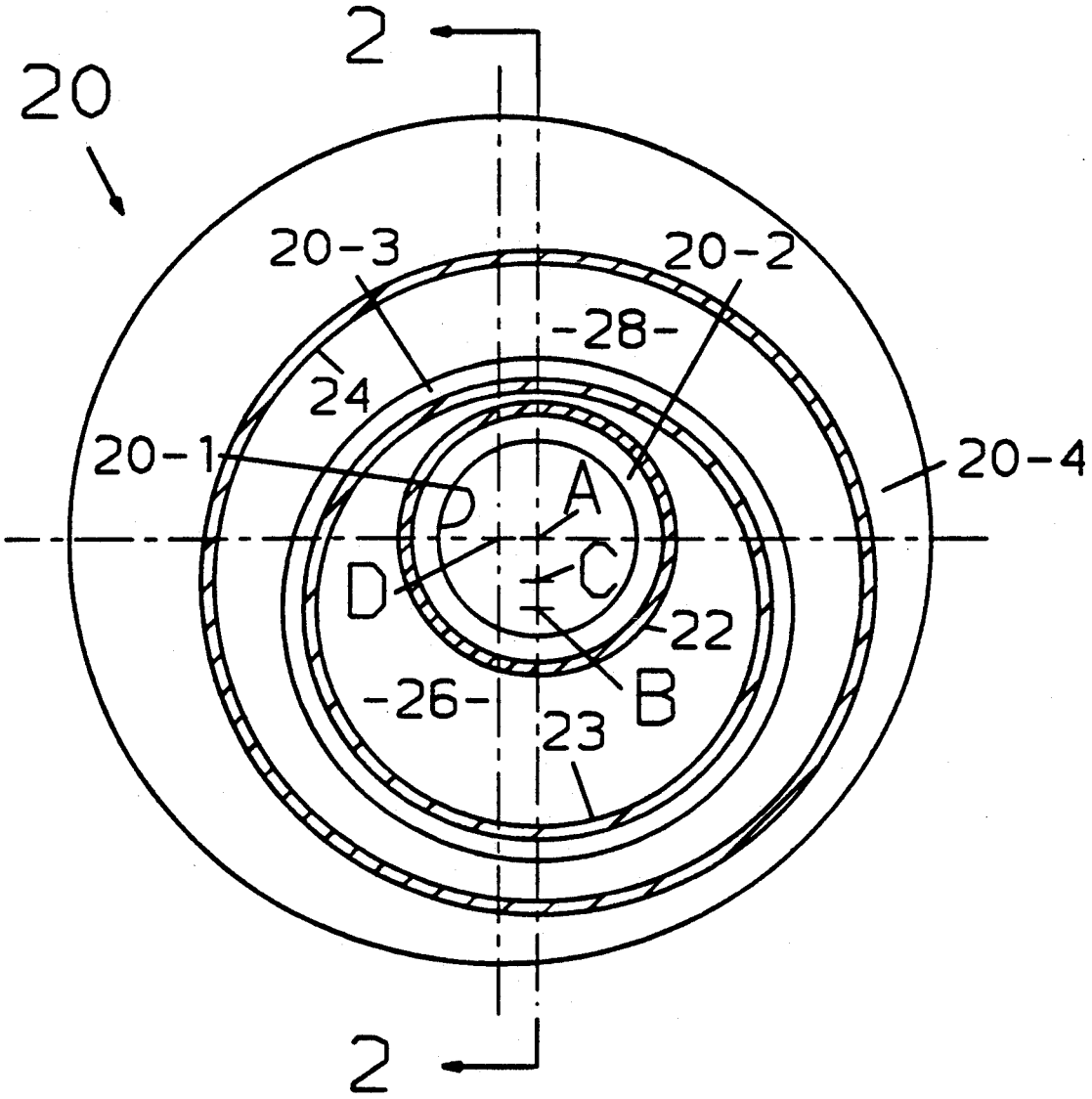
FIG. 1 is a top view of the slider block and seal plate with the seals shown in section.

In FIG. 1 the number 20 generally designates the combined slider block and seal plate of the present invention. With additional reference to FIG. 2, it will be noted that circular plate 20 has a bore 20-1 formed therein with bore 20-1 being partially defined by coaxial extension 20-2 and centered on axis A—A which appears as point A in FIG. 1 and which is also the axis of orbiting scroll 30. A second axial extension 20-3 centered on axis B—B, which appears as point B in FIG. 1, is located radially outward of and eccentrically located with respect to extension 20-2. A third asymmetrical axial extension 20-4 has an inner circular portion centered on axis C—C, which appears as point C in FIG. 1 and is located radially outward of and eccentrically located with respect to extensions 20-2 and 20-3 such that axis C—C is coplanar with and located intermediate axes A—A and B—B. A first annular seal 22 surrounds and is supported by extension 20-2. A second annular seal 23 is located radially inward of and in supported engagement with extension 20-3. A third annular seal 24 is located radially inward of and in supported engagement with the inner circular portion of extension 20-4. The asymmetrical annular space between annular seals 22 and 23 defines a first pressure chamber 26 and the asymmetrical annular space between annular seals 23 and 24 defines a second pressure chamber 28.

Figure 2:
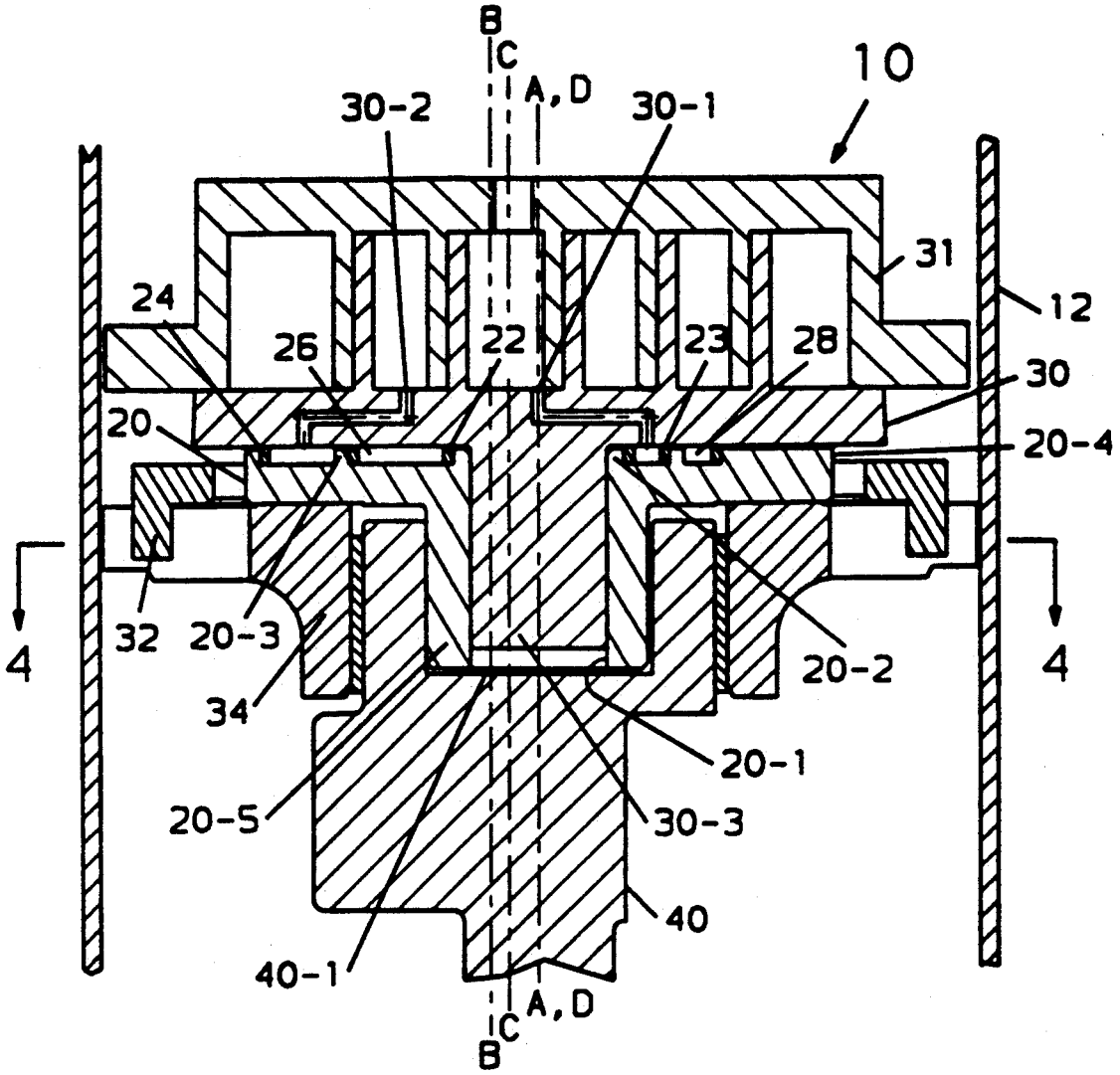
FIG. 2 is a vertical view through a portion of a scroll compressor along a line corresponding to 2—2 of FIG. 1.
Figure 3A:
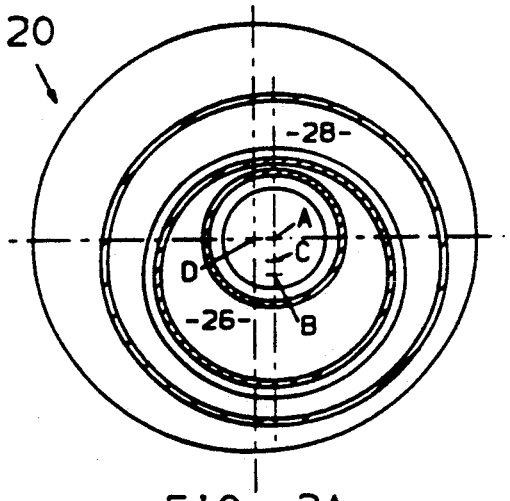
FIGS. 3A-D correspond to FIG. 1 but show the various locations of the slider block and seal plate at 90° intervals relative to the axis of the crankshaft.
Figure 3B:
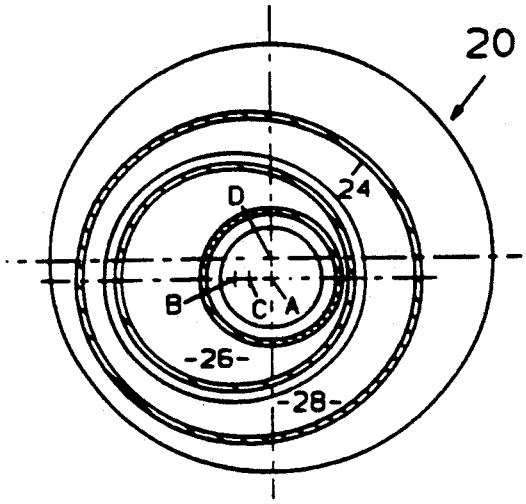
Figure 3D:
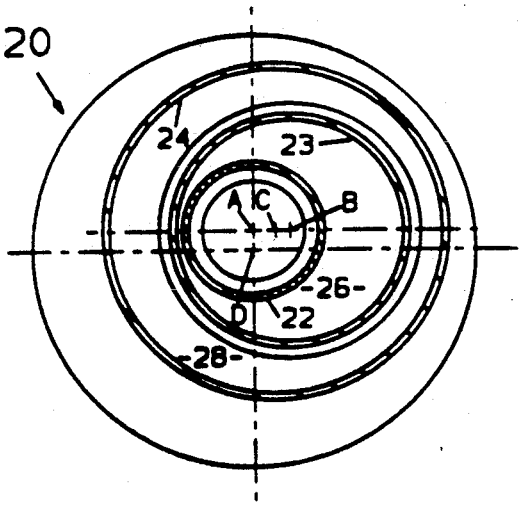
Figure 3C:
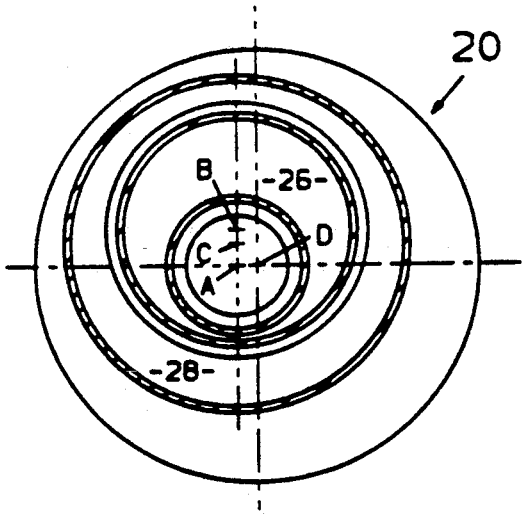
Figure 4:
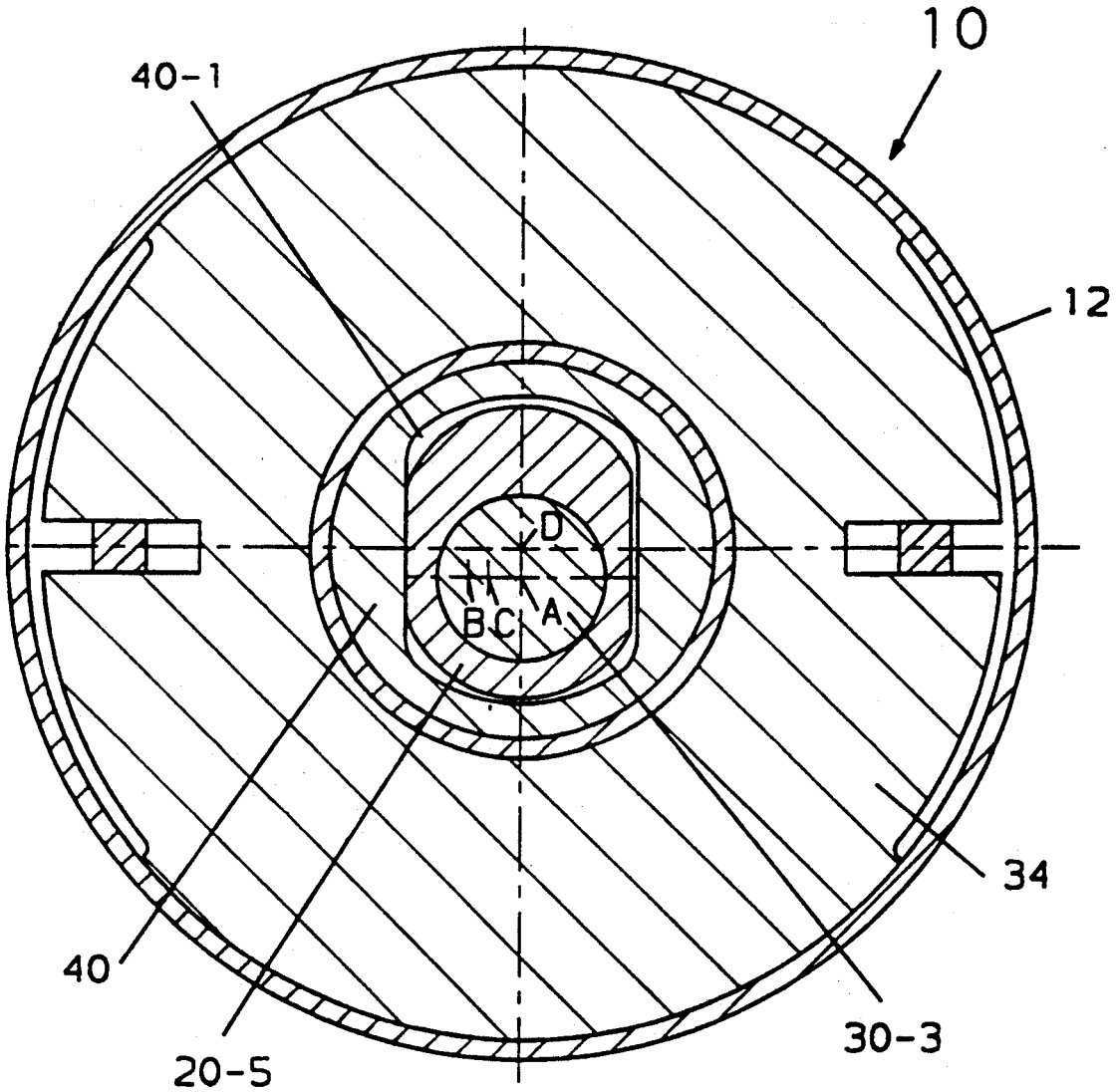
FIG. 4 is a sectional view taken along 4—4 of FIG. 2.

Referring now to FIG. 2, it will be noted that chambers 26 and 28 are located between orbiting scroll 30 and combined slider block and seal plate 20 in hermetic scroll compressor 10. Slider block and seal plate 20 is surrounded by Oldham coupling 32 and is supported in shell 12 by crankcase 34. Chamber 26 is connected via restricted fluid path 30-1 in orbiting scroll 30 with the discharge pressure in hermetic scroll compressor 10 while chamber 28 is connected via restricted fluid path 30-2 in orbiting scroll 30 with an intermediate compression pressure in the scroll compressor 10. Thus, the chamber 26 is responsive to discharge pressure which is not necessarily the same as the highest pressure reached in the compression process while chamber 28 is responsive to suction pressure in that it influences the intermediate pressure. Referring additionally to FIG. 4, boss 30-3 of orbiting scroll 30 is received in bore 20-1 and coacts with integral slider block portion 20-5 of slider block and seal plate 20. Slider block portion 20-5 is of a elongated shape with flat sides and rounded ends and is received in elongated recess 40-1 in crankshaft 40 so that when crankshaft 40 is rotated about its axis D—D, which appears as point D in FIGS. 1, 3A-D, and 4, slider block and seal plate 20 and seals 22-24 carried thereby rotate as a unit with the crankshaft 40 about axis D—D as is best shown in FIGS. 3A-D. Slider block and seal plate 20 is capable of limited radial movement in the plane defined by axis A—A and D—D to ride over liquid slugs, grit etc. but would normally be at its outermost position during operation. However, the nose of slider block portion 20-5, as illustrated, does not touch the inside radius on the crankshaft 40. As is conventional, orbiting scroll 30 moves in an orbiting motion while crankshaft 40 is being rotated. Referring specifically to FIGS. 3A-D which represent the relative positions of the members at 90° intervals, it will be noted that chambers 26 and 28 and the plane defined by axes A—A, C—C, and B—B, change their position relative to axis D—D as well as to the orbiting scroll 30. As noted above A—A represents both the axis of orbiting scroll 30 and the axis of axial extension 20-2/seal 22. So while orbiting scroll 30 is orbiting as represented by the movement of point A relative to point D in FIGS. 3A-D, the slider block and seal plate 20 and its seals 22-24 are rotating as represented by the movement of the plane defined by axes A—A, C—C, and B—B relative to axis D—D shown as points A-D in FIGS. 3A-D. The net effect is to have the areas of chambers 26 and 28 90° ahead of the orbiting scroll 30. As shown in FIG. 3A, which is the same as FIG. 1, point A and therefore the orbiting scroll 30 is at its rightmost position and centrifugal force acts along the plane defined by D—D and A—A but the areas of chambers 26 and 28 are generally at their bottom most position. This results in the areas of the trapped volumes defined between orbiting scroll 30 and the fixed scroll 31 having their major areas 90° ahead of and 90° behind the major areas of chambers 26 and 28 since a scroll compressor has symmetrically located trapped volumes. Also, the centrifugal force acts 90° behind the major areas of chambers 26 and 28. FIGS. 3B-D show the locations of the chambers 26 and 28 and axis A—A, B—B, C—C and D—D at 90° increments starting from the FIG. 3A position but the relative positions of the trapped volumes and centrifugal force relative to the positions of chambers 26 and 28 remains constant.

Because pressure chambers 26 and 28 rotate with respect to the back face of orbiting scroll 30 which partially defines chambers 26 and 28, pressure chambers 26 and 28 are located in an eccentric manner rather than being centered on the orbiting scroll 30. Therefore, the net pressure force on the orbiting scroll always creates a restoring moment to counteract the overturning moment due to gas compression forces in addition to providing an axial bias for axial compliance. Referring to the free body diagram of FIG. 5, it will be noted that the tangential gas force produces an overturning moment which the present invention seeks to balance as well as to provide sealing between the orbiting scroll 30 and fixed scroll 31. Referring now to FIG. 6, it will be noted that the back pressure chambers 26 and 28 plus the thrust face reaction force $F_R$, coact to produce a restoring moment which balances the overturning moment.

Although a preferred embodiment of the present invention has been described and illustrated, other changes will occur to those skilled in the art. For example, the slider block and seal plate can be separate members and the seal plate could be part of the crankshaft. Also, a single pocket defined between seals 22 and 24 could be used. It is therefore intended that the scope of the present invention is to be limited only by the scope of the appended claims.

What is claimed is:

1. In a scroll compressor means having a fixed scroll, an orbiting scroll having an axis, a crankshaft rotatable about an axes spaced from said axis of said orbiting scroll for driving said orbiting scroll, axial compliant means comprising:

seal plate means rotatably driven by said crankshaft about said axis of said crankshaft;

seal means carried by said seal plate means and including an inner seal having an axis generally coaxial with said axis of said orbiting scroll and an outer seal having an axis spaced from said axes of said crankshaft and said orbiting scroll;

said seal means, said seal plate means and said orbiting scroll coacting to define pressure pocket means eccentrically located with respect to said axes of said crankshaft and said orbiting scroll such that said pressure pocket means rotate with respect to said axis of said orbiting scroll.

2. The axial compliant means of claim 1 wherein said seal means further includes a middle seal located between and eccentrically located with respect to both said inner and outer seals whereby said pressure pocket means include a pair of pressure pockets.

3. The axial compliant means of claim 2 further including means for applying discharge pressure to said pressure pocket defined between said inner and middle seals.

4. The axial compliant means of claim 1 wherein said seal means further includes a middle seal located between said inner and outer seals and having an axis with said axis of said outer seal being located intermediate said axes of said inner and middle seals whereby said pressure pocket means includes a pair of pressure pockets.

5. The axial compliant means of claim 4 wherein said axes of said inner, middle, and outer seals are coplanar.

6. The axial compliant means of claim 5 wherein said axis of said crankshaft and said axis of said orbiting scroll define a plane perpendicular to said plane defined by said axes of said inner, middle and outer seals.

7. The axial compliant means of claim 6 wherein said seal plate means further includes slider block means.

8. The axial compliant means of claim 4 wherein said pair of pressure pockets have centroids which are coplanar with said axes of said inner, middle and outer seals.

9. The axial compliant means of claim 1 wherein said seal plate means further includes slider block means.

10. A combined slider block and seal plate means comprising:

a generally circular plate having a first and a second side;

an elongated slider block means located on said second side and integral with said plate and adapted to be received in and driven by a crankshaft about an axis of said crankshaft;

a bore extending through said plate and into said slider block means and adapted to receive a boss of an orbiting scroll and be coaxial therewith;

an inner annular axial extension formed on said first side surrounding and forming a portion of said bore and having an axis coaxial with said bore and spaced from said axis of said crankshaft;

an outer axial extension having an inner circular portion having an axis spaced from said axis of said inner axial extension whereby pocket means are formed between said inner and outer axial extensions and are eccentrically located with respect to said axes of said crankshaft and orbiting scroll and rotate with said slider block means with respect to said axis of said orbiting scroll.

11. The combined slider block and seal plate means of claim 10 further comprising:

a middle annular axial extension located intermediate said inner and outer axial extensions and having an axis with said axis of said outer axial extension being located intermediate said axes of said inner and middle axial extensions whereby said pocket means includes two eccentrically located annular pressure pockets.

12. The combined slider block and seal plate means of claim 11 wherein said axes of said inner, middle and outer axial extensions are coplanar.

13. The combined slider block and seal plate means of claim 12 wherein said axis of said crankshaft and said axis of said orbiting scroll define a plane perpendicular to said plane defined by said inner middle and outer axial extensions.

14. The combined slider block and seal plate means of claim 11 wherein said two pressure pockets have centroids which are coplanar with said axes of said inner, middle and outer axial extensions.

* * * * *